US006672297B1

(12) United States Patent
Liao

(10) Patent No.: US 6,672,297 B1
(45) Date of Patent: Jan. 6, 2004

(54) BASEBALL PITCHING MACHINE

(76) Inventor: Grace Liao, 9F, No. 196, Ming-Sheng Rd., Hsinchu City (TW)

( * ) Notice: Subject to any disclaimer, the term of this patent is extended or adjusted under 35 U.S.C. 154(b) by 0 days.

(21) Appl. No.: 10/374,393

(22) Filed: Feb. 25, 2003

(51) Int. Cl.[7] ..... A63B 69/00
(52) U.S. Cl. ..... 124/6; 124/78
(58) Field of Search ..... 473/451, 422; 124/1, 6, 78

(56) References Cited

U.S. PATENT DOCUMENTS 5,832,909 A * 11/1998 Grant et al. ..... 124/6
6,443,859 B1 * 9/2002 Markin ..... 473/451

* cited by examiner

*Primary Examiner*—Jacob K. Ackun

(57) ABSTRACT

A baseball pitching machine includes a support portion on which a case is mounted for accommodating a friction wheel operatively coupled to a motor. A tube is mounted to the case and defines a ball passage in communication with the case. The tube includes a straight shooting section and an angled feeding section having an inlet opening to which a cap is connected. The cap is normally closed to prevent foreign objects from entering the pitching machine. A detection member is mounted in the inlet opening of the feeding section and is actuateable by opening the cap to give off an audio warning via a speaker. The cap has stop plates for prevents the ball from directly traveling to the shooting section before the cap is closed.

7 Claims, 5 Drawing Sheets

BASEBALL PITCHING MACHINE

FIELD OF THE INVENTION

The present invention relates to a baseball pitching machine, and in particular to a pitching machine comprising a speaker for giving a warning to a batter so that the batter can get ready before the pitching machine throws a ball.

BACKGROUND OF THE INVENTION

A conventional baseball pitching machine generally includes a tube and a friction wheel coupled to the tube. When a baseball is put into the tube through an inlet opening and guided to the friction wheel. The friction wheel that rotates at a high speed engages and drives the ball through the tube with high speed to make a throw.

In the conventional baseball pitching machine, the distance between the inlet opening of the tube and the friction wheel is short and the ball is thrown out almost immediately after the ball is put into the machine, so that the batter has to react within a very short period of time. Nevertheless, this is not exactly the same situation that a batter faces the pitcher in a real baseball game. In a real game, the pitcher has to take certain actions before he or she throws the ball. Correspondingly, the batter has a period of time to prepare. In other words, the batter has enough time to expect when the ball is pitched and then to adjust his or her pose. Therefore, the operator who operates the pitching machine has to yell to notice the batter that the ball is dropped into the tube and this is a burden for the operator to yell hundreds of time. Besides, if an object other than a ball is dropped in the tube, the operator cannot pick it out and this could damage the machine and/or the batter.

The present invention provides a baseball pitching machine that has a cap for preventing objects from accidentally getting into the tube and the cap activates a speaker and/or a light signal to notice the batter that a ball is to be pitched.

SUMMARY OF THE INVENTION

In accordance with the present invention, there is provided a baseball pitching machine comprising a support portion on which a case is mounted for accommodating a friction wheel operatively coupled to a motor. A tube is mounted to the case and defines a ball passage in communication with the case. The tube comprises a straight shooting section and an angled feeding section having an inlet opening to which a cap is connected. The cap is normally closed to prevent foreign objects from entering the pitching machine. A detection member is mounted in the inlet opening of the feeding section and is actuateable by opening the cap to give off an audio warning via a speaker. The cap has stop plates for prevents the ball from directly traveling to the shooting section before the cap is closed.

The present invention will become more obvious from the following description when taken in connection with the accompanying drawings which show, for purposes of illustration only, preferred embodiments in accordance with the present invention.

DETAILED DESCRIPTION OF PREFERRED EMBODIMENTS

Figure 1:
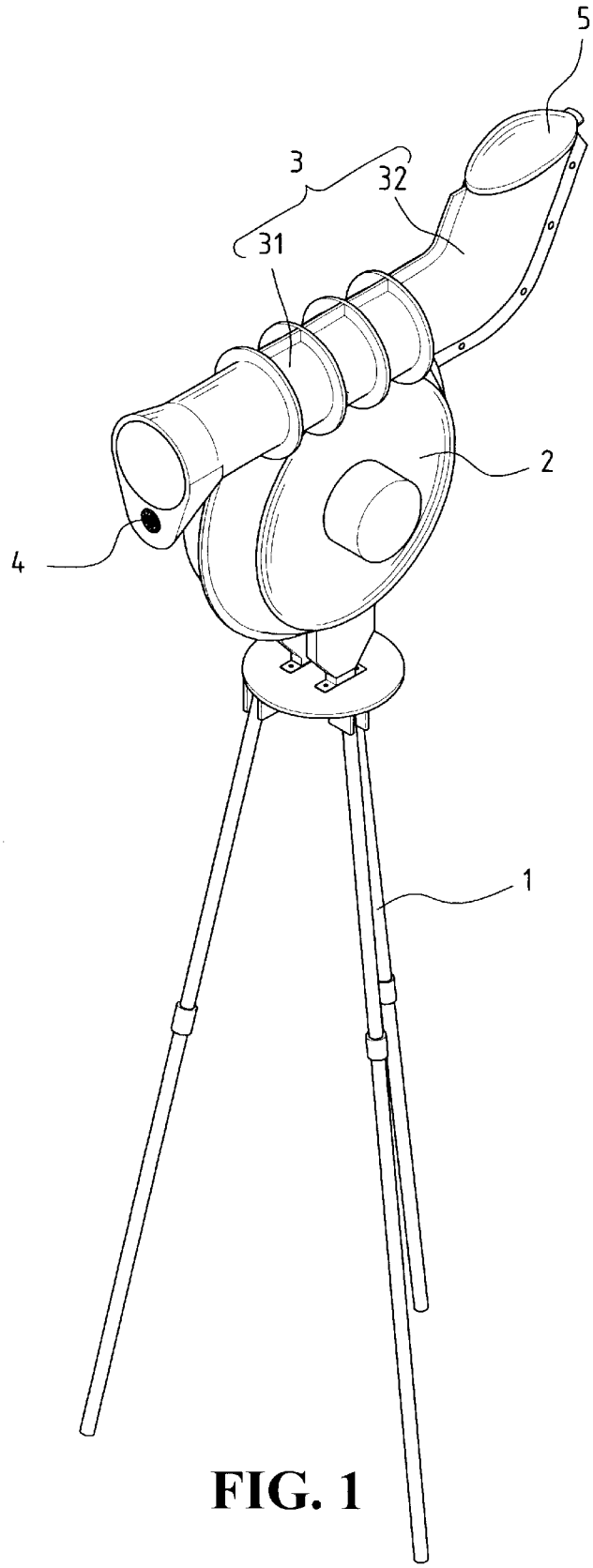
FIG. 1 is a perspective view of a pitching machine in accordance with the present invention.
Figure 2:
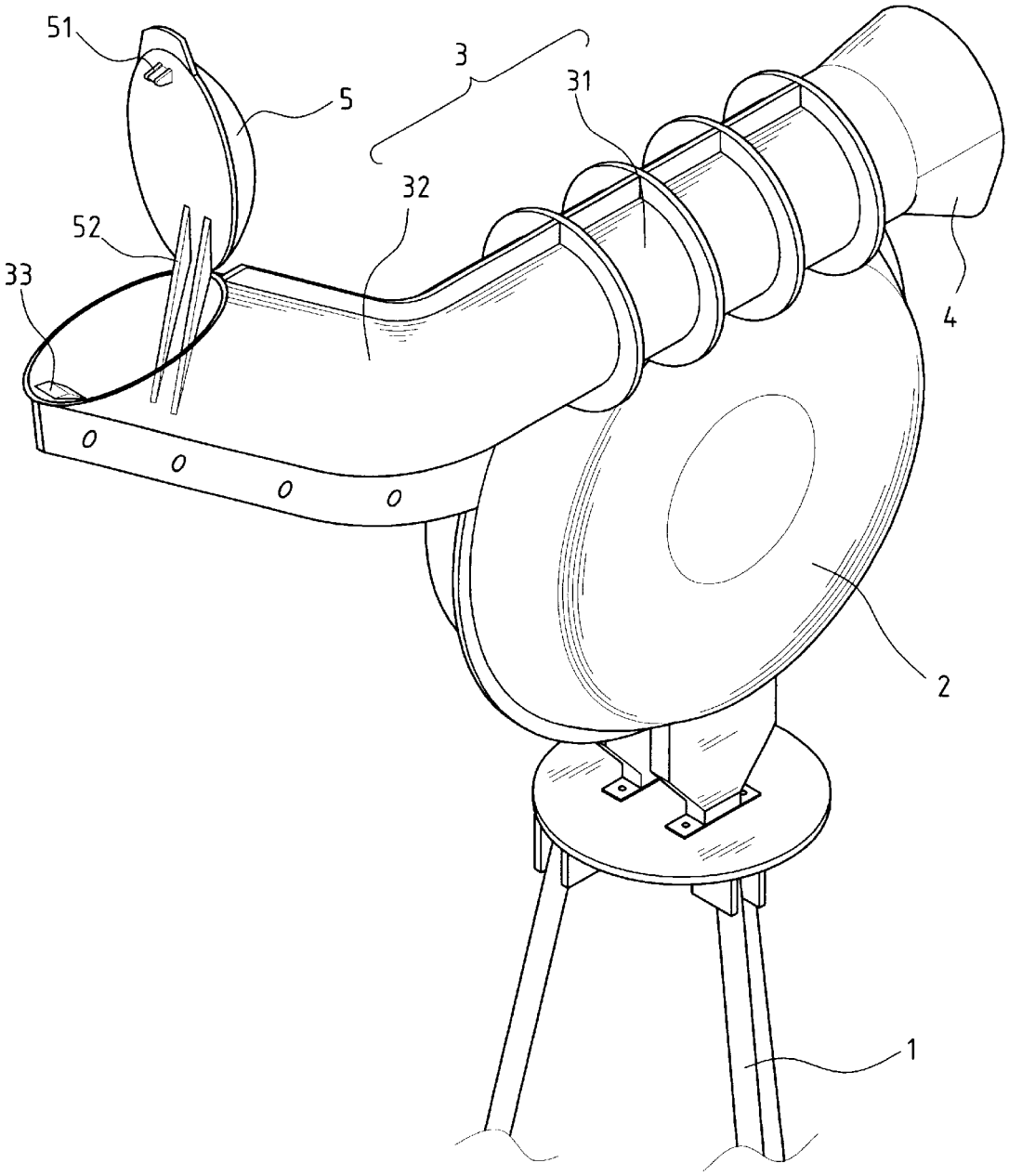
FIG. 2 is an enlarged view of the pitching machine of the present invention, taken at different perspective.
Figure 3:
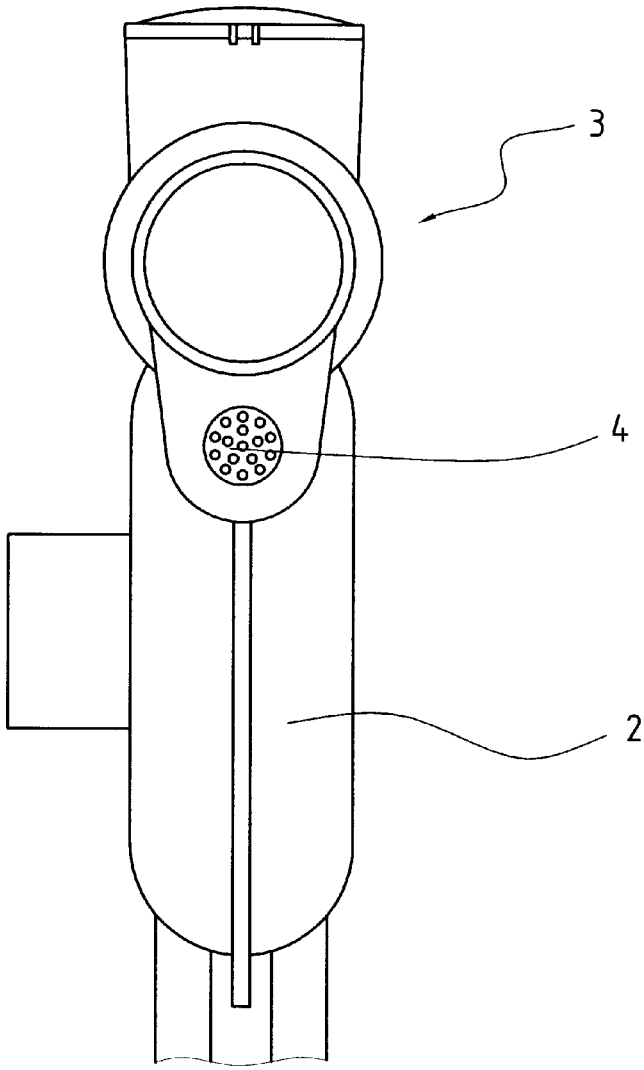
FIG. 3 is a front view of the pitching machine of the present invention.

Referring to FIGS. 1 to 3, a baseball pitching machine constructed in accordance with the present invention comprises a support portion 1, which is a tripod with retractable legs in the embodiment illustrated. Mounted on the support portion 1 is a case 2 defining an interior space in which a friction wheel drivingly coupled to a motor (both not shown for simplicity) is enclosed. The friction wheel and the motor are well known in the art and thus not shown and described herein.

A tube 3 is mounted to the case 2, defining a ball passage (not labeled) in communication with the interior space of the case 2. The tube 3 comprises a straight shooting section 31 and a feeding section 32 that is angled and has an open end extending upward for receiving a baseball. The baseball is put into the pitching machine by being dropped into the tube 3 via the open end of the feeding section 32. The baseball is then guided by the tube 3 toward and thus engaging the friction wheel. The friction wheel frictionally engages and drives the baseball through the tube 3 with a high speed whereby the baseball is thrown out of the shooting section 31 from a front open end of the shooting section 31.

A detection member or sensor 33 is mounted in the open end of the feeding section 32. A cap 5 is pivotably connected to the open end of the feeding section 32 for selectively closing the open end. In the embodiment illustrated, the cap 5 is normally closed to prevent foreign objects from unexpectedly entering the pitching machine. The cap 5 has an activation piece 51 connected at a periphery of the inside of the cap 5 and the activation piece 51 activates the detection member 33 when the cap 5 is open and/or closed. Stop plates 52 extend from an inside surface of the cap 5 into the open end of the feeding section 23 for preventing the baseball from directly entering the shooting section 31 of the tube 3.

A speaker 4 is mounted to the pitching machine for giving an audio warning to a batter. Preferably and as illustrated in the drawings, the speaker 4 is mounted adjacent the open end of the shooting section 31 of the tube 3. The speaker 4 is controlled by the detection member 33 that is in turn actuated by the activation piece 51. In accordance with the present invention, when the cap 5 is open, the activation piece 51 actuates the detection member 33, which in turn activates the speaker 4 to give off the audio warning. Since opening the cap 5 is inherently an indication of attempt to drop a baseball into the pitching machine and since the baseball will then be thrown by the pitching machine, giving off the warning at the time when the cap 5 is open will give a batter sufficient to get ready for batting. Thus, it is not necessary to active the speaker 4 again to give off the warning when the cap 5 is closed or alternatively, the speaker 4 is turned off when the cap 5 is closed. However, if desired, the speaker 4 can be activated again or the audio warning can be further extended after the cap 5 is closed.

To operate, an operator opens the cap 5 and drops a baseball in the tube 3 via the open end of the feeding section 32. The audio warning is emitted. The ball rolls down the upward feeding section 32 and then shoots out by the friction wheel. Since the feeding section 23 has a substantial length, which delays the time of engagement between the baseball and the friction after the cap 5 is timely closed. Thus, the batter has enough time to prepare and the batter feels like in a real baseball game.

Figure 4:
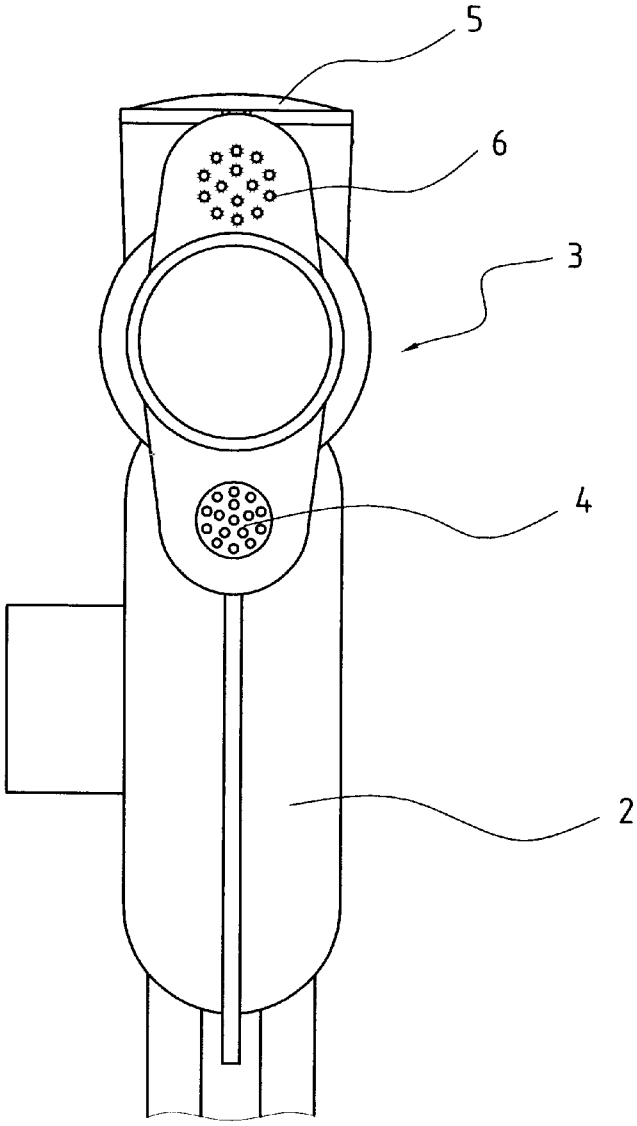
FIG. 4 is a front view of a pitching machine in accordance with a different embodiment of the present invention in which a light signal device is incorporated to give off a warning.

Referring to FIG. 4, a light signal device 6, selectively giving off a visual warning, may be mounted to the pitching machine, preferably at the front open end of the shooting section 31 of the tube 3. The light signal device 6 is electrically connected to and controlled by the detection member 33. Therefore, the batter can receive a specific visual'signal, preferably of different colors, to notice the situation of the pitching machine. A green light is shown when the machine is in operation and when the cap 5 is open, a red light is displayed, preferably in combination with the audio warning given off by the speaker 4.

Figure 5:
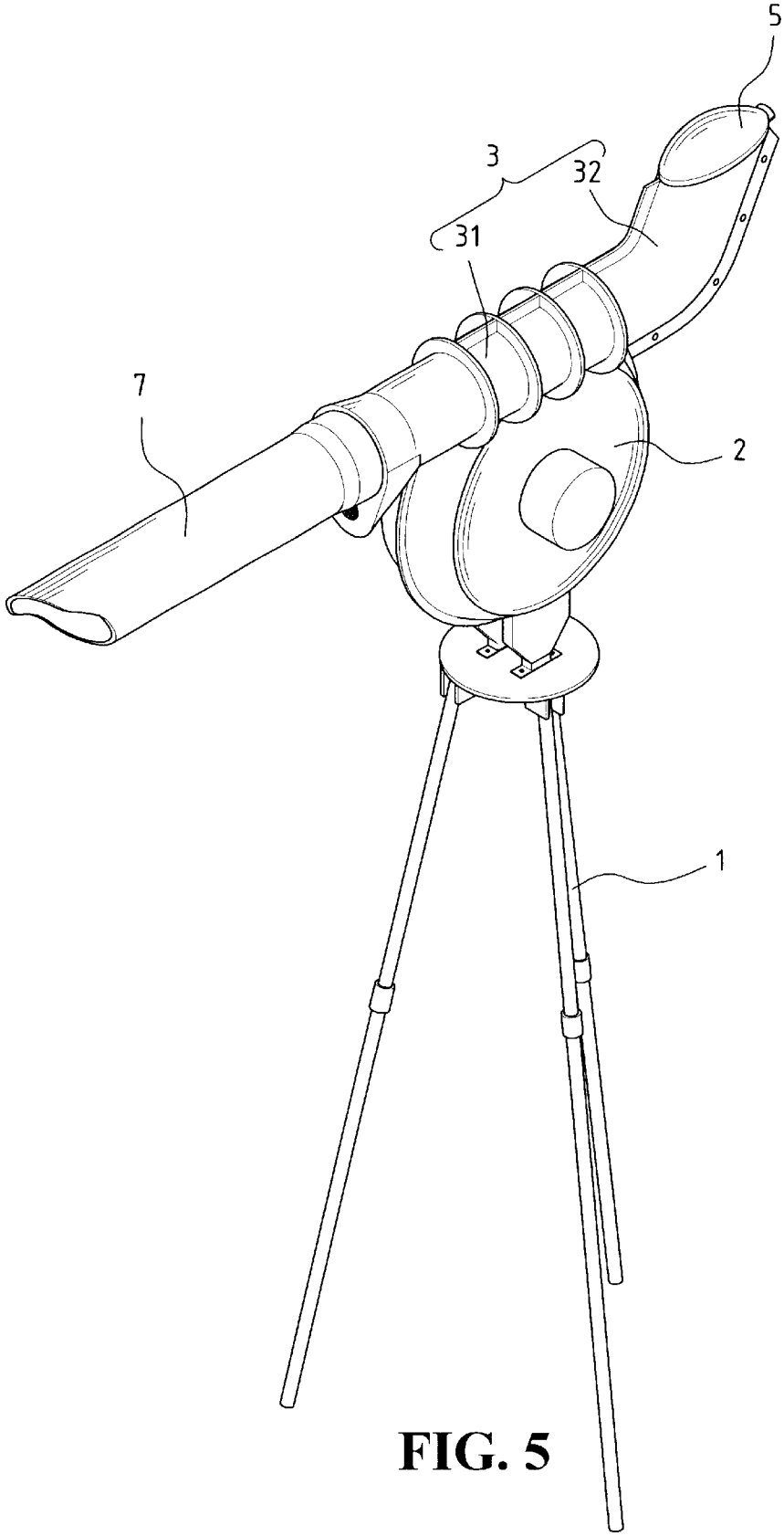
FIG. 5 is a perspective view of a pitching machine in accordance with a further embodiment of the present invention in which an extension tube is provided for guiding the movement of a ball thrown by the pitching machine of the present invention.

FIG. 5 shows a modification of the pitching machine of the present invention in which an extension tube 7 is connected to the front open end of the shooting section 31 for better guiding the shooting of the ball.

While the preferred embodiments of the present invention have been shown and described to illustrate the present invention, it is apparent to those skilled in the art that further embodiments may be made without departing from the scope of the present invention.

What is claimed is:

1. A pitching machine comprising:

a support portion;

a case mounted on the support portion and defining an interior space for accommodating a friction wheel operatively coupled to a motor;

a tube mounted to the case and defining a ball passage in communication with the interior space of the case, the tube comprising a shooting section corresponding in position to the case and a feeding section having an inlet opening extending upward for receiving a ball, the shooting section having a front open end through which a ball is shot;

a cap rotatably mounted to the feeding section for openably closing the inlet opening; and a detection member mounted in the feeding section and actuateable by the cap to give off a warning via a warning device.

2. The pitching machine as claimed in claim 1, wherein the warning device comprises a speaker.

3. The pitching machine as claimed in claim 1, wherein the warning device comprises a light signal device that gives off a visual signal.

4. The pitching machine as claimed in claim 3, wherein the visual signal comprises light of different colors to indicate different operation status of the pitching machine.

5. The pitching machine as claimed in claim 1 further comprising an extension tube connected to the front open end of the shooting section.

6. The pitching machine as claimed in claim 1, wherein the cap comprises an activation piece that actuates the detection member when the cap is open.

7. The pitching machine as claimed in claim 1, wherein the cap comprises stop members that prevents the ball from directly traveling into the shooting section before the cap is closed.

* * * * *